US005281047A

United States Patent [19]

Skaug

[11] Patent Number: 5,281,047

[45] Date of Patent: Jan. 25, 1994

[54] MASONRY LANDSCAPING MODULES AND METHODS OF LANDSCAPING

[76] Inventor: Richard Skaug, 6905 10th St., Rio Linda, Calif. 95673

[21] Appl. No.: 890,641

[22] Filed: May 28, 1992

[51] Int. Cl.[5] ..... E01C 5/00

[52] U.S. Cl. ..... 404/42; 404/31; 404/44; 52/315; 52/389

[58] Field of Search ..... 404/28, 29, 30, 31, 404/42, 43, 44, 45, 70; 52/314, 315, 311.1, 311.2, 389

[56] References Cited

U.S. PATENT DOCUMENTS

| | | | |
|---|---|---|---|
| 400,997 | 4/1889 | Berrie . | |
| 584,269 | 6/1897 | Northcutt | 404/42 |
| 1,885,720 | 11/1937 | Hewett | 404/44 |
| 1,977,021 | 10/1934 | Spencer | 47/33 |
| 3,304,673 | 2/1967 | Ramoneda | 52/220 |
| 3,314,193 | 4/1967 | Chancellor | 47/33 |
| 3,762,113 | 10/1973 | O'Mullan et al. | 52/102 |
| 4,016,692 | 4/1977 | Jordan et al. | 52/314 |
| 5,054,957 | 10/1991 | Johnson | 404/41 |

FOREIGN PATENT DOCUMENTS

| | | | |
|---|---|---|---|
| 2622610 | 5/1989 | France . | |
| 515330 | 2/1955 | Italy . | |
| 316012 | 7/1929 | United Kingdom | 52/314 |
| 597092 | 1/1948 | United Kingdom | 404/42 |
| 2223249 | 4/1990 | United Kingdom . | |

OTHER PUBLICATIONS

Engineering News-Record; "Building a Reinforced Brick Pavement", Nov. 1938.

*Primary Examiner*—William P. Neuder
*Attorney, Agent, or Firm*—E. Michael Combs

[57] ABSTRACT

Masonry landscaping modules and methods for landscaping using the modules are disclosed. The masonry modules each have an upper portion comprising a plurality of masonry elements bonded to an upper surface of a lower portion. The masonry elements, preferably clay brick, are arranged in predetermined patterns and spaced from each other on the upper surface of the lower portion to define masonry joints between them. The lower portion comprises a concrete base having side walls which taper inwardly toward a bottom surface of the lower portion to define a trapezoidally shaped lower portion. Either steel reinforcing bars or fiberglass fibers are embedded in the lower portion. In completed products such as patios and walkways where multiple modules are placed adjacent to each other, inverted Y-shaped or "key" paving joints are formed between modules. Methods of laying the modules to form a variety of masonry products such as paving and other decorative arrangements are disclosed.

19 Claims, 4 Drawing Sheets

MASONRY LANDSCAPING MODULES AND METHODS OF LANDSCAPING

BACKGROUND OF THE INVENTION

1. Field of the Invention

The field of the invention relates generally to paving and landscaping, and more particularly to masonry landscaping modules, and methods for landscaping and paving using those modules.

2. Description of the Prior Art

Various paving components for paving and landscaping land areas have been utilized in the prior art. For example, separate masonry paving elements such as clay bricks, stones, slate, etc. have been conventionally used by both skilled and amateur masons. Further, a wide variety of landscaping modules have also been employed such as unitary masonry sections marked with grooves to simulate a module having multiple paving elements, and flexible edging or border strips having a plurality of separate horizontal sections attached to a common vertical section. The noted edging strips are made of galvanized sheet metal or polymeric material. Still further, numerous masonry landscaping modules comprising separate paving elements embedded in concrete bases are known in the prior art, wherein the paving elements are constructed of masonry material or those which simulate masonry material.

Accordingly, it may be appreciated that there continues to be a need for new and improved masonry landscaping modules and methods for landscaping using those modules which addresses both the problems of simplicity and ease of use to effectively enable the amateur or relatively unskilled mason, i.e. the "do-it-yourselfer", to perform paving and landscaping activities in a time efficient manner to produce finished landscapes which duplicate the finished work of the skilled or professional mason. In this respect, the present invention fulfills this need.

SUMMARY OF THE INVENTION

In view of the disadvantages inherent in the known types of materials and methods for paving and landscaping now present in the prior art, the present invention provides masonry landscaping modules and methods for landscaping using those modules which are easy to handle and install by the "do-it-yourselfer" to provide professionally laid and finished masonry work. As such, the general purpose of the present invention, which will be described subsequently in greater detail, is to provide new and improved masonry landscaping modules and methods of landscaping and paving using those modules which have all the advantages of the prior art materials and methods for paving and landscaping and none of the disadvantages.

To attain this, the present invention includes masonry modules each having an upper portion comprising a plurality of masonry elements bonded to an upper surface of a lower portion. The masonry elements, preferably clay brick, are arranged in predetermined patterns and spaced from each other on the upper surface to define masonry joints between them. The lower portion comprises a concrete base having side walls which taper inwardly toward a bottom surface of the lower portion to define a trapezoidally shaped lower portion. Steel reinforcing bars are embedded in the lower portion. In completed products such as patios and walkways where multiple modules are placed in spaced relationship to each other, inverted Y-shaped or "key" joints are formed between the modules. Methods of laying the modules to form a variety of masonry products such as paving and other decorative landscaping arrangements are disclosed.

My invention resides not in any one of these features per se, but rather in the particular combination of all of them herein disclosed and claimed and it is distinguished from the prior art in this particular combination of all of its structures and procedures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the included abstract is to enable the U.S. Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The abstract is neither intended to define the invention of the application, which is measured by the claims, nor is it intended to be limiting as to the scope of the invention in any way.

It is therefore an object of the present invention to provide new and improved masonry landscaping modules which may be easily and efficiently manufactured and marketed.

It is a further object of the present invention to provide new and improved masonry landscaping modules which are of durable and reliable construction, and have design configurations, weights, and dimensions which enable the do-it-yourselfer to easily and quickly produce professionally finished masonry products.

An even further object of the present invention is to provide new and improved masonry landscaping modules which are susceptible of a low cost of manufacture with regard to both materials and labor, and which accordingly are then susceptible of low prices of sale to the consuming public, thereby making such masonry landscaping modules economically available to the buying public.

Still another object of the present invention is to provide new and improved methods for landscaping and paving using the inventive masonry landscaping modules.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
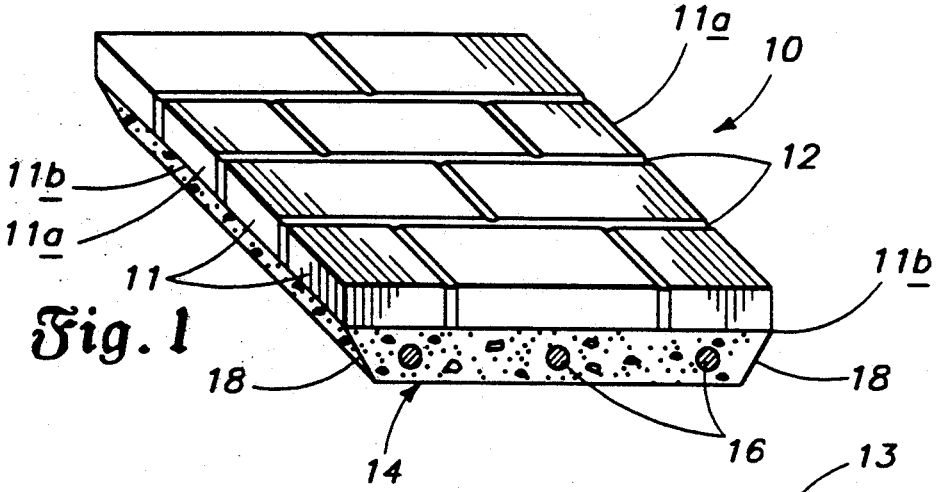
FIG. 1 is a perspective view of a first embodiment of the masonry landscaping module of the present invention.

With reference now to the drawings, and in particular to FIGS. 1-15 thereof, new and improved masonry landscaping modules and methods of landscaping embodying the principles and concepts of the present invention and generally designated by the reference numerals 10,19,26,34,40,42,46,52,57,69,77,82,86,and 90 will be described.

Figure 2:
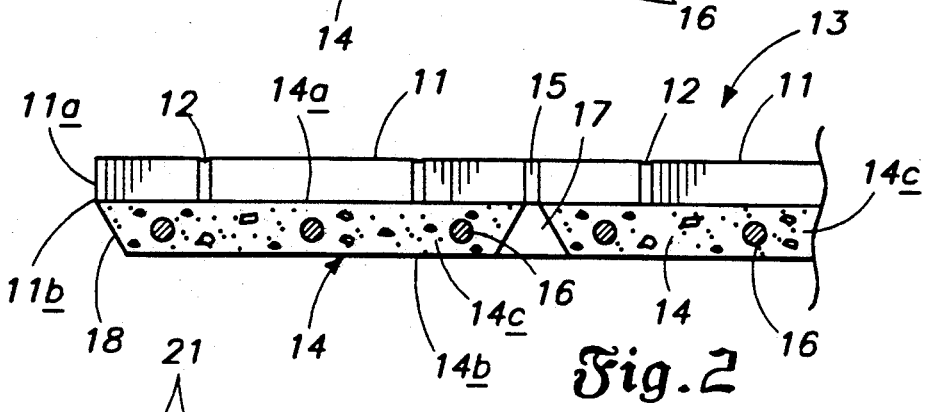
FIG. 2 is a partial end view of a paved area using the modules of FIG. 1.

More specifically, and with particular reference to FIGS.1 and 2, a masonry landscaping module 10 of a first embodiment of the invention comprises an upper portion having a plurality of masonry elements 11 evenly spaced from each other by a plurality of mortar joints 12 of uniform width. Elements 11 are arranged in a predetermined pattern across module 10 and define a first portion of a side configuration for module 10 which comprises a pair of elongate, vertically-oriented planar side walls 11*a* which are parallel to each other. The pattern comprises a plurality of courses or rows having a plurality of elements 11 and joints 12 in each course, with the elements 11 and joints 12 of adjacent courses being arranged in offset relationship to each other. Elements are bonded to the upper surface 14*a* of a concrete lower portion 14. Embedded in the concrete of lower portion 14 are a plurality of parallel reinforcing bars 16, or alternatively, fiberglass fibers (not shown), which extend completely through lower portion 14. Bars 16, which may be composed of #9 steel wire, or the embedded fiberglass fibers, not only provide increased strength to the module 10 but also enable easy cutting of the module for custom fitting purposes without the need for special cutting tools, e.g. by using a conventional circular saw with a masonry blade. Lower portion 14 has a pair of side surfaces which define a second portion of said side configuration, wherein said side surfaces extend from bottom edges 11*b* of side walls 11*a* at the juncture of the larger upper surface 14*a* of lower portion 14 downwardly and inwardly to its smaller bottom surface 14*b* to define a pair of angled side surfaces 18 (FIG. 2). A pair of parallel end surfaces 14*c* extend from said upper surface 14*a* to said lower surface 14*b*, and said angled side surfaces 18 further extend between said parallel end surfaces 14*c*, to form, together with said upper and lower surfaces 14*a*,14*b*, a solid trapezoidally shaped lower portion 14. One of the significant advantages of angled side surfaces 18 is realized during its manufacture, i.e. mechanical pickup means can grasp modules 10 along the angled side surfaces 18, stack them on storage pallets, and subsequently remove them from the pallets for further processing due to the triangular gap existing between the stacked modules. Masonry elements 11 are preferably clay bricks which are relatively porous and therefore do not require the use of bonding agents to bond them to the upper surface of lower portion 14. Other types of masonry elements such as stone, slate, etc. may also be used to construct the upper portion; however, since they are less porous than clay brick, bonding agents would be required. Modules 10 are dimensioned primarily for patio and walkway paving; for example, 20"×20"×2" thick. Module dimensions are selected to provide modules 10 having an optimum balance of bulk and weight to enable the do-it-yourselfer to easily handle the modules and professionally construct the desired patio, walkway, or other paved area in a minimal amount of time.

Referring now to FIG.2, the further significance of angled side surfaces 18 will be discussed. In a finished paved area, modules 10 are separated by paving joints 13 having substantially rectangular upper sections 15 adjacent to the upper portions of adjacent modules 10 defined by masonry elements 11, as well as contiguous, trapezoidal lower sections 17 formed by the angled side surfaces 18 of adjacent modules 10. Accordingly, sections 15 and 17 define a joint 13 having an inverted Y shape wherein lower sections 17 provide "keys" or wedges between adjacent modules 10 to form a tight and compact masonry structure. The trapezoidal spaces which form joint sections 17 between modules 10 allow "finger space" for the do-it-yourselfer to grasp and position modules precisely on a sand bed from above without resorting to dropping the module in position from above or sliding it laterally into position which would produce the undesirable effect of destroying the smooth and level condition of an underlying sand support layer. Furthermore, the trapezoidal spaces which form joint sections 17 permit placement of further reinforcing bars therein where further rigidity and load bearing capacity of the paved product is required. For example, ½" wide rectangular spaces which separate the upper portions of the modules and form joint sections 15 allow placement of ⅜"reinforcing bars in the trapezoidal spaces which form sections 17 so that the bars can be fully surrounded and embedded in the mortar or grout material of the joint 13.

Figure 3:
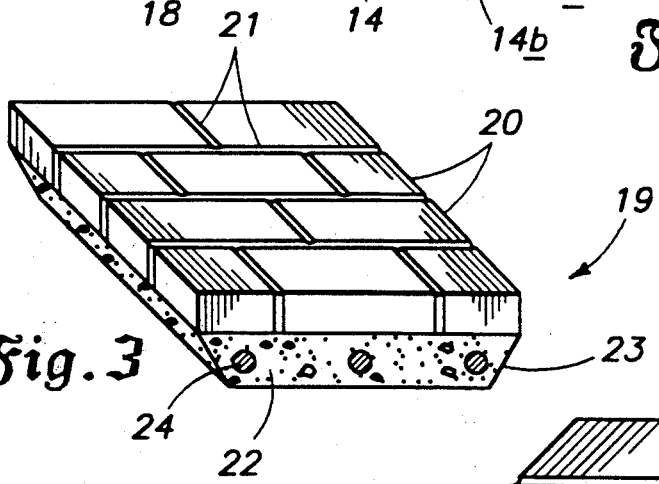
FIG. 3 is a perspective view of a second embodiment of the masonry landscaping module of the present invention.

FIG.3 illustrates another masonry module 19 having a structure basically identical that of module 10, i.e. an upper portion comprised of a plurality of masonry elements 20, preferably clay brick, which are uniformly separated by mortar joints 21 and arranged in the same pattern as elements 11 of module 10. Elements 20 are bonded to an upper surface of a concrete lower portion 22 which has inwardly angled side surfaces 23 and plural reinforcing bars 24 embedded therein. However, modules 19 are alternatively sized for use as stepping stones; for example, 12"×12"×2" thick. Once again, the dimensions for modules 19 are selected to provide optimum ease of handling and installation for their intended use in the same manner as modules 10.

Figure 4:
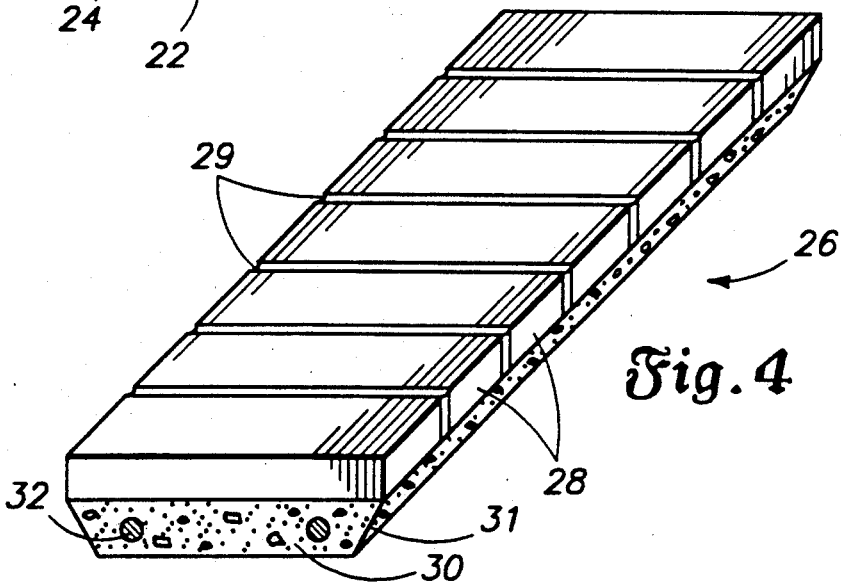
FIG. 4 is a perspective view of a third embodiment of the masonry landscaping module of the present invention.
Figure 5:
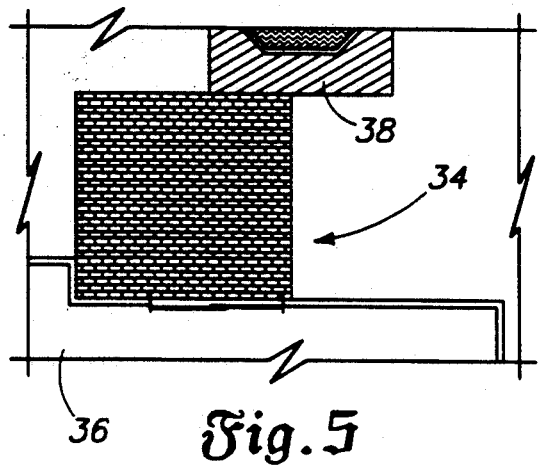
FIG. 5 is a plan view of a residential yard area having a patio constructed with the module of FIG.1.
Figure 6:
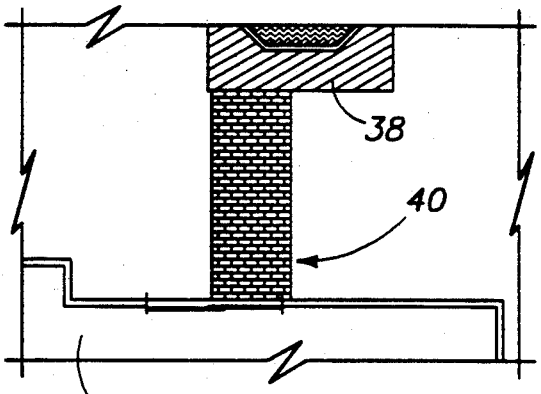
FIG. 6 is a plan view of a residential yard area having a walkway constructed with the module of FIG.1.

FIG.4 shows still another masonry module 26 having a structure substantially the same as that of modules 10 and 19, i.e. an upper portion comprised of a plurality of masonry elements 28, preferably clay brick, which are equally spaced by mortar joints 29 arranged in a column or "soldier" pattern. Elements 28 are bonded to an upper surface of a concrete lower portion 30 which has inwardly angled side surfaces 31 and a plurality of reinforcing bars 32 embedded therein. However, modules 26 are alternatively dimensioned for use as either lawn edges, borders for driveways, gardens, flower beds, etc., or expansion joints in concrete structures; for example, 8"×36"×3" thick. Similarly, the dimensions of modules 26 are calculated to provide optimum ease of handling and installation for their intended use in the same manner as modules 10 and 19.

Figure 7:
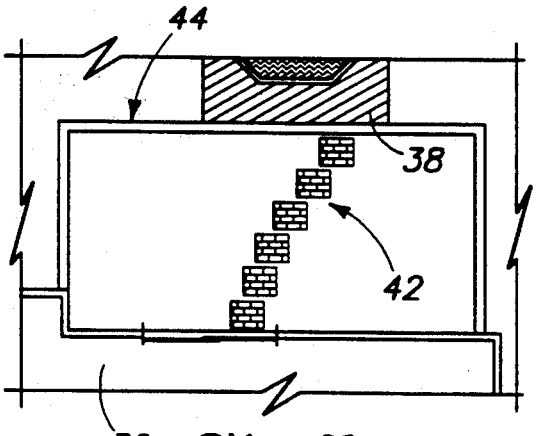
FIG. 7 is a plan view of a residential yard area having an openly paved curved walkway and a surrounding border constructed with the modules of FIGS.3 and 4.
Figure 8:
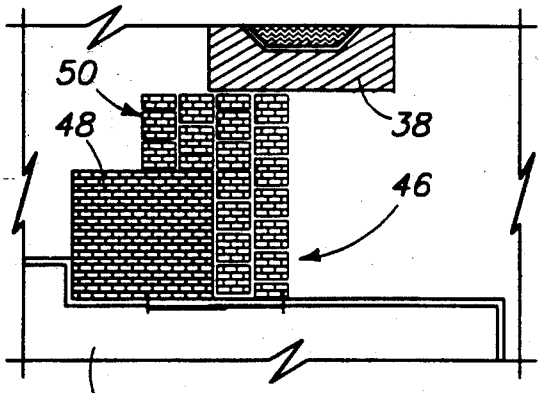
FIG. 8 is a plan view of a residential yard area having a combination patio and adjacent open paving section constructed with the modules of FIGS.1 and 3.
Figure 9:
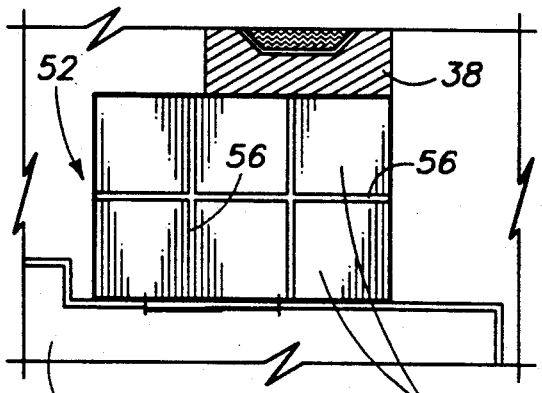
FIG. 9 is a plan view of a residential yard area having a concrete patio constructed with the module of FIG.4 which is used as an expansion joint.

FIGS.5–9 are illustrative of the many landscaping uses of the masonry modules 10, 19, and 26. For example, modules 10 may be used to construct either a patio 34 (FIG.5) or a walkway 40 (FIG.6) between a residence 36 and a spa or pool 38 in a backyard area. Further, modules 19 and 26 may be used in combination to form a decorative curved path 42 comprised of separated modules 19 (stepping stones), said path 42 being surrounded by a border 44 formed by modules 26 (FIG.7). Similarly, modules 10 and 19 may also be used in combination to form a landscaped area 46 comprising a patio 48 built with modules 10, and an adjacent open paved section 50 formed with modules 19(stepping stones) as shown in FIG.8. Still further, modules 26 may be used as expansion joints in concrete as illustrated in FIG.9 wherein a patio 52 is comprised of a plurality of concrete sections 54 separated by expansion joints 56 made from modules 26.

Figure 10:
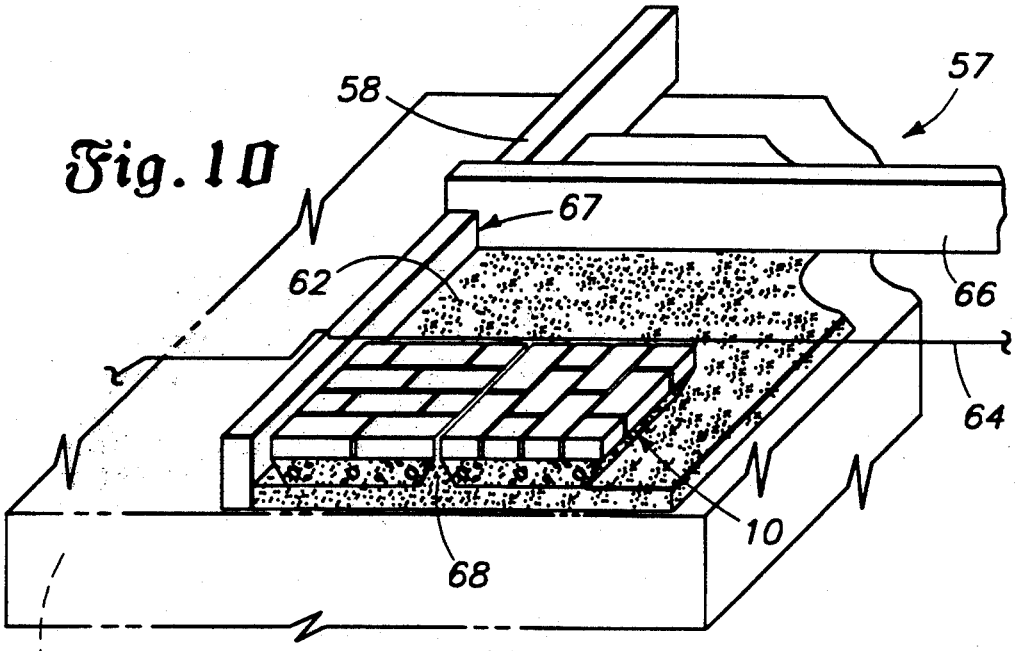
FIG. 10 is a perspective view of an arrangement for constructing patios and walkways using the modules of FIGS.1 and 3.
Figure 11:
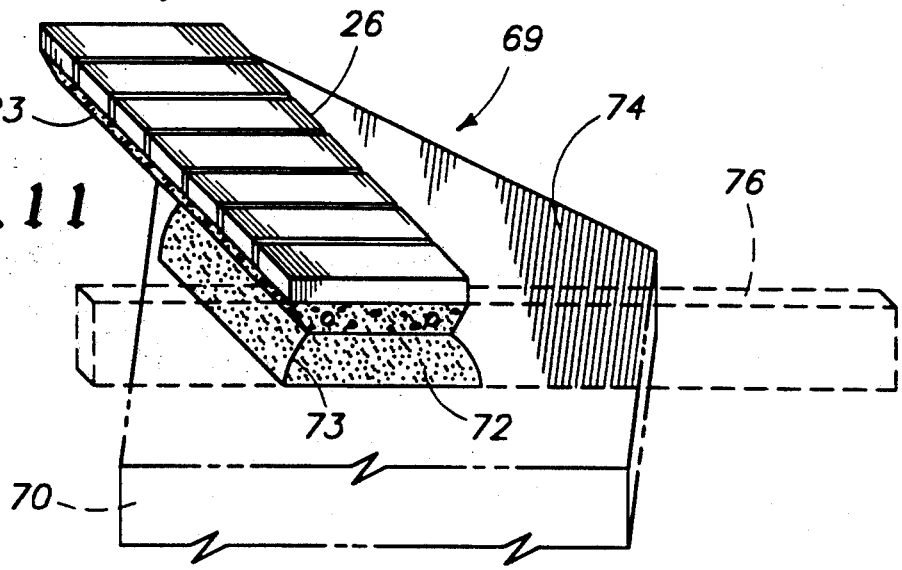
FIG. 11 is a perspective view of an arrangement for concrete paving using the module of FIG.4 as an expansion joint.
Figure 12:
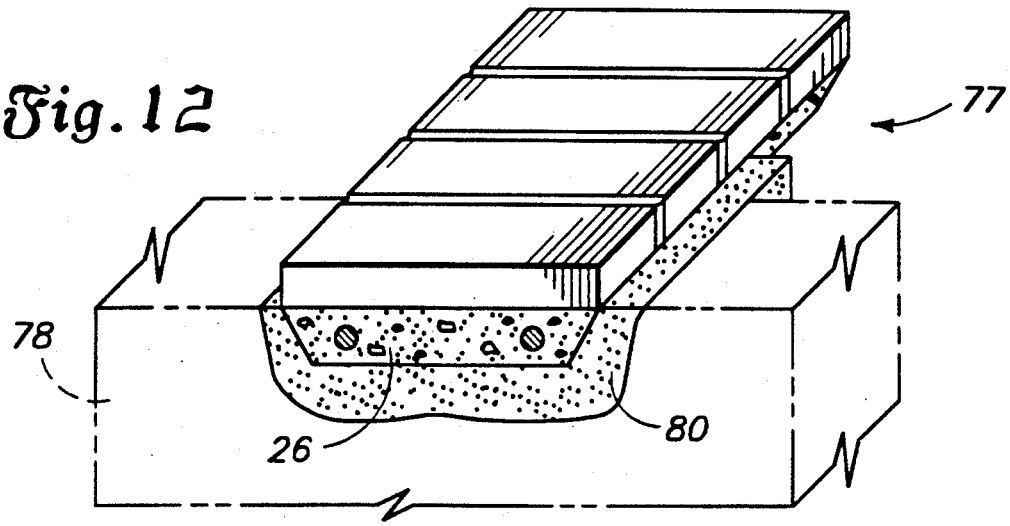
FIG. 12 is a perspective view of the module of FIG.4 embedded in a soil substrate.

FIGS. 10–12 illustrate the procedures used to landscape selected ground areas using masonry modules 10,19,and 26. FIG.10 shows an arrangement 57 for paving a selected stable ground area with modules 10. The ground area is first marked and then a wood form comprised of boards (preferably 2"×4") 58 is placed around the entire perimeter of the ground area (only one form board 58 is shown for the sake of clarity). Preferably, wood forms of either redwood or treated lumber are used since they can be left in place when the landscaping is completed. Sand is then deposited within the wood form to depth of approximately 1". A 2"×4" smoothing board 66 having a two and one half inch notch 67 on each end is positioned across the ground area with the notches positioned in sliding contact with the upper 2" surfaces of a pair of form boards 58 positioned on opposite sides of the ground area. Board 66 is then slid along opposed form boards 58 to smooth and level the sand to form a base 62 for the modules 10 on the sub soil 60. A course aligning string 64 is stretched across the form to align a first course of modules 10. A first module 10 is grasped along its side surfaces and placed on sand base 62 along string 64. As previously noted above, angled side surfaces 18 provide "finger spaces" which enable precise placement of the modules 10 on base 62 without disrupting it. A second module 10 is placed on base 62 along string 64 in spaced relationship to the first module 10 to form an inverted Y-shaped space between them in which inverted Y-shaped joints 68 are formed. Joints 68 are structurally identical to joints 13. The process is repeated until the width of the ground area is covered, i.e. the first course is completed. Further courses are laid in the same manner to complete the paving of the ground area. Joints 68 may filled with sand, or filled halfway with sand at the bottom and completed with mortar. Alternatively, when greater load bearing capacity is required, the trapezoidally shaped lower sections of joints 68, are first partially filled with mortar or grout, reinforcing bars are inserted into the partially filled lower sections, and the joints 68 are then completely filled with mortar to embed the reinforcing bars therein.

FIG.11 shows an arrangement 69 for landscaping a selected stable ground area by paving the area with concrete having expansion joints formed with masonry modules 26. The ground area is first marked and its perimeter is surrounded with a wood frame partially illustrated by form board 76. An aligning string (not shown) is stretched across the frame and a layer of sand 72, or concrete (not shown), is placed on sub soil 70 along the string and levelled. A masonry module 26 is placed on sand 72 and pressed into position so that the top edge of module 26 touches the string. During the placement of module 26, the sand 72 is formed with a pair of outwardly angled sides 73 due to the combined effect of the downward pressure of module 26 and the force of gravity. Together with the angled side surfaces 23 of module 26, sides 73 provide key or wedge shaped surfaces against which concrete 74 is poured to provide a tight and interlocking fit therebetween.

In FIG.12, an emplacement 77 for masonry modules 26 is shown. Preparation of emplacement 77 is effected by first digging a trench 9" wide and 4" deep in sub soil 78, and then depositing about 2" of sand in the trench. The sand is smoothed and levelled by laying a 6 foot 2"×8" board flat in the trench and moving it in both length and width directions to provide a sand base 80. Module 26 is then placed in the trench on sand base 80 and levelled if necessary. The sides of the trench around module 26 are filled with sand to complete the installation.

Figure 13:
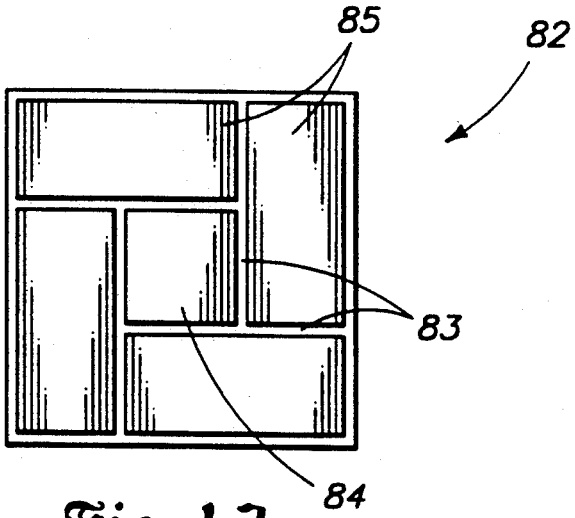
FIG. 13 is a top plan view of an alternative embodiment of the module of FIG.3.
Figure 14:
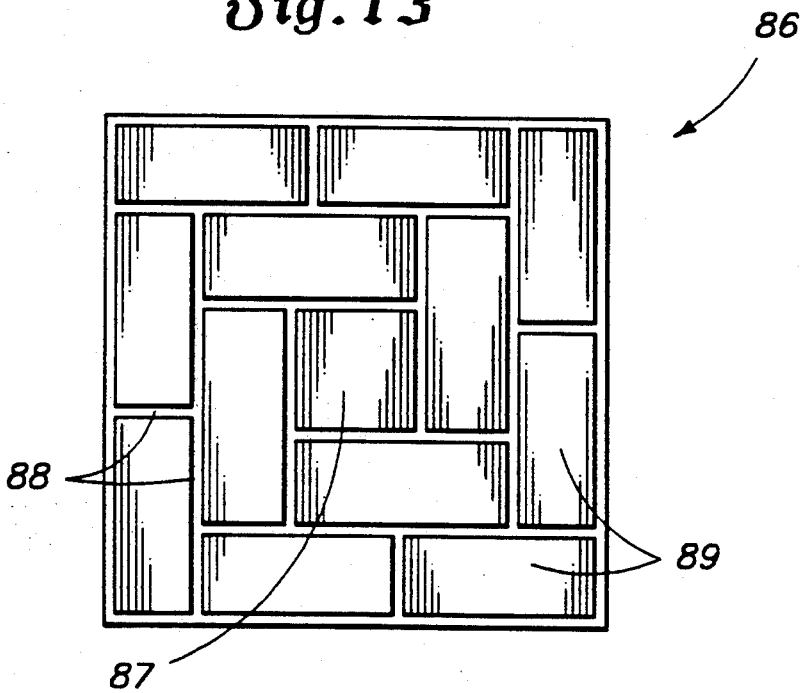
FIG. 14 is a top plan view of an alternative embodiment of the module of FIG.1.
Figure 15:
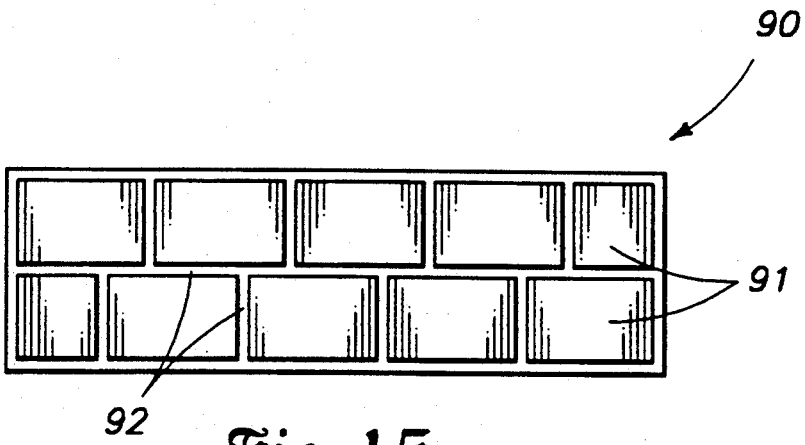
FIG. 15 is a top plan view of an alternative embodiment of the module of FIG.4.

FIGS.13–15 depict alternative arrangements for the predetermined patterns of the masonry elements bonded to the upper surfaces of the lower portions of modules 10,19,and 26. In FIG.13, a module 82, substantially identical in structure to module 19, has an alternative masonry element pattern comprising one element 84 bonded to the upper surface at its center, and a plurality of elements 85 positioned completely around element 84 in a "bullseye" pattern. Elements 84,85 are separated by uniform joints 83. Since this pattern has no continuous joints across the module, the probability of cracking is reduced. FIG.14 shows another module 86, substantially identical in structure to module 10, which has the same basic "bullseye" pattern of module 19 with the addition of a second plurality of surrounding elements. More specifically, one element 87 is positioned at the center of the upper surface, a first plurality of elements 89 completely surrounds element 84, and a second plurality of elements 89 surround both the first plurality of elements 89 and center element 87. Elements 87,89 are separated by uniform joints 88. In FIG.15, a module 90, substantially identical in structure to module 26, is provided with two courses or longitudinal rows of elements 91 separated by uniform joints 92. Elements 91 and joints 92 of each of the two courses are arranged in offset relationship to each other, thus providing a pattern that has no continuous joints across the module which reduces the chances of cracking.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A masonry landscaping module comprising:

an upper portion having a plurality of masonry elements spaced from each other by a plurality of mortar joints of uniform width, said masonry elements being arranged in a predetermined pattern, said masonry elements defining a first portion of an outer side configuration for said module which comprises a pair of elongate, vertically-oriented planar side walls which are parallel to each other;

a concrete lower portion having an upper surface, said masonry elements being bonded to said upper surface;

said concrete lower portion having a bottom surface spaced from said upper surface, said bottom surface being smaller than said upper surface, a pair of parallel end surfaces extending from said upper surface to said lower surface, and a pair of side surfaces, wherein each of said side surfaces extend from a bottom edge of each of said side walls downwardly and inwardly from said upper surface to said smaller bottom surface to define a pair of angled side surfaces which comprise a second portion of said outer side configuration, said angled side surfaces further extending between said end surfaces to form, together with said upper and lower surfaces, a solid, substantially trapezoidally shaped lower portion; and a plurality of reinforcing means embedded in said lower portion, said reinforcing means extending completely through said lower portion.

2. The masonry landscaping module of claim 1, wherein said masonry elements are clay bricks.

3. The masonry landscaping module of claim 1, wherein said plurality of reinforcing means are bars constructed of #9 steel wire.

4. The masonry landscaping module of claim 1, wherein said plurality of reinforcing means are fibers constructed of fiberglass.

5. The masonry landscaping module of claim 1, wherein said predetermined pattern includes a plurality of courses, each course having a plurality of said masonry elements and said masonry joints, and said masonry elements and masonry joints of adjacent ones of said courses are arranged in offset relationship to each other.

6. The masonry landscaping module of claim 1, wherein said predetermined pattern includes a single course of a plurality of said masonry elements.

7. The masonry landscaping module of claim 1, wherein said predetermined pattern includes a first masonry element bonded to said upper surface at a center position thereon, and a plurality of second masonry elements positioned completely around the periphery of said first masonry element to enclose said first masonry elements therein.

8. The masonry landscaping module of claim 7, wherein said predetermined pattern further includes a plurality of third masonry elements positioned completely around the periphery of said first masonry element and said plurality of second masonry elements to enclose said first masonry element and said plurality of second masonry elements therein.

9. The masonry landscaping module of claim 1, wherein said predetermined pattern includes two courses, each course having a plurality of said masonry elements and masonry joints, and said masonry elements and masonry joints of each of said two courses are arranged in offset relationship to each other.

10. A paved masonry structure comprising:

a support base;

a plurality of masonry modules positioned on said support base, said masonry modules being equally spaced from each other by a plurality of paving joints of uniform configuration;

wherein each of said masonry modules includes an upper portion having a plurality of masonry elements spaced from each other by a plurality of mortar joints of uniform width, said masonry elements being arranged in a predetermined pattern, said masonry elements defining a first portion of an outer side configuration for said modules which comprises a pair of elongate, vertically-oriented planar side walls which are parallel to each other; a concrete lower portion having an upper surface, said masonry elements being bonded to said upper surface; said concrete lower portion having a bottom surface spaced from said upper surface, said bottom surface being smaller than said upper surface; a pair of parallel end surfaces extending from said upper surface to said lower surface; a pair of side surfaces, wherein each of said side surfaces extend from a bottom edge of each of said side walls downwardly and inwardly from said upper surface to said smaller bottom surface to define a pair of angled side surfaces which comprise a second portion of said of said outer side configuration, said angled side surfaces further extending between said end surfaces to form, together with said upper and lower surfaces, a solid substantially trapezoidally shaped lower portion; and a plurality of reinforcing means embedded in said lower portion, said reinforcing means extending completely through said lower portion; and wherein said paving joints include a substantially rectangular upper section adjacent to said upper section of adjacent masonry modules of said plurality of modules, and a contiguous, substantially trapezoidal lower section adjacent to said angled side surfaces of said adjacent masonry modules, said upper and lower sections together defining a paving joint having an inverted Y shape.

11. The paved masonry structure of claim 10, wherein said paving joints are composed of sand.

12. The paved masonry structure of claim 10, wherein said lower sections of said paving joints are composed of sand, and said upper sections thereof are composed of mortar.

13. The paved masonry structure of claim 10, wherein said paving joints are composed of mortar.

14. The paved masonry structure of claim 13, further comprising a reinforcing bar embedded in each lower section of each paving joint.

15. A method of landscaping a ground area using masonry landscaping modules comprising the steps of:

making a stable ground area to be landscaped;

forming a smooth and flat sand base in said stable ground area;

placing a first masonry landscaping module on said sand base, wherein said first masonry landscaping module includes an upper portion having a plurality of masonry elements spaced from each other by a plurality of mortar joints of uniform width, said masonry elements being arranged in a predetermined pattern, said masonry elements defining a first portion of an outer side configuration for said modules which comprises a pair of elongate, vertically-oriented planar side walls which are parallel to each other; a concrete lower portion having an upper surface, said masonry elements being bonded to said upper surface; said concrete lower portion having a bottom surface spaced from said upper surface, said bottom surface being smaller than said upper surface; a pair of parallel end surfaces extending from said upper surface to said lower surface, and a pair of side surfaces, wherein each of said side surfaces extend from a bottom edge of each of said side walls downwardly and inwardly from said upper surface to said smaller bottom surface to define a pair of angled side surfaces which comprise a second portion of said outer side configuration, said angled side surfaces extending between said end surfaces to form, together with said upper and lower surfaces, a solid, substantially trapezoidally shaped lower portion; and a plurality of reinforcing means embedded in said lower portion, said reinforcing means extending completely through said lower portion; and levelling said first masonry module on said sand base.

16. The method of landscaping a ground area using masonry modules as set forth in claim 15, comprising the further steps of:

placing a second masonry module on said and base in alignment with and spaced from said first masonry module to provide an inverted Y-shaped joint forming space between them defined by a rectangular upper section adjacent to said upper sections of said first and second modules, and a contiguous trapezoidal lower section adjacent to said angled side surfaces of said first and second modules;

repeating said preceding placing step using third, fourth, fifth, and nth masonry modules until said stable ground area to be landscaped is covered; and filling the joint forming spaces with mortar to provide paving joints between all of the modules placed in said stable ground area.

17. The method of landscaping a ground area using masonry modules as set forth in claim 16, wherein said filling step includes partially filling said trapezoidal lower sections of said joint forming spaces, inserting reinforcing bars into said partially filled lower sections, and then adding more mortar to completely fill said joint forming spaces.

18. The method of landscaping a ground area using masonry modules as set forth in claim 15, wherein during said placing step, applying sufficient pressure to said first module to form a pair of outwardly angled sides along said sand base which form, together with said angled side surfaces of said first module, a pair of key or wedge shaped surfaces; and pouring a layer of concrete along said key or wedge shaped surfaces.

19. The method of landscaping a ground area using masonry modules as set forth in claim 15, comprising the further steps of:

after said marking step and before said forming step, digging a trench in said stable ground area sized to accommodate said first module;

wherein said forming step includes depositing a layer of sand into said trench, and then smoothing and flattening said layer of sand; and after said levelling step, filling portions of said trench around said first module with sand.

* * * * *